United States Patent [19]

Mulder

[11] Patent Number: 5,066,323

[45] Date of Patent: Nov. 19, 1991

[54] COMPOSITIONS COMPRISING HEXAFLUOROPHOSPHATES AND METALS AS STRUCTURE REFINER FOR ALUMINIUM-SILICON ALLOYS

[75] Inventor: Jan P. Mulder, Delfzijl, Netherlands

[73] Assignee: Shell Internationale Research Maatschappij B.V., The Hague, Netherlands

[21] Appl. No.: 363,848

[22] Filed: Jun. 12, 1989

[30] Foreign Application Priority Data

Jun. 13, 1988 [GB] United Kingdom ..... 8813939

[51] Int. Cl.[5] ..... C22C 1/06

[52] U.S. Cl. ..... 75/305; 75/309; 75/310

[58] Field of Search ..... 75/93 AC, 68 R, 256, 75/257, 309, 310, 305; 420/548, 549, 529, 537; 423/301

[56] References Cited

U.S. PATENT DOCUMENTS

| | | | |
|---|---|---|---|
| 3,380,803 | 4/1968 | Jache et al. | 423/301 |
| 3,933,476 | 1/1976 | Chopra et al. | 75/68 R |
| 3,953,202 | 4/1976 | Rasmussen | 420/548 |
| 4,302,249 | 11/1981 | Chernogorenko | 420/548 |

FOREIGN PATENT DOCUMENTS

| | | | |
|---|---|---|---|
| 9846 | 1/1982 | Japan | 75/93 AC |
| 920603 | 3/1963 | United Kingdom | 420/537 |

*Primary Examiner*—Melvyn J. Andrews

[57] ABSTRACT

Hexafluorophosphates may be used as structure refiner during solidification of molten aluminium-silicon alloys. The structure refining effect is obtained almost immediately after addition of the hexafluorophosphate to the molten alloy. The hexafluorophosphates are preferably used in the form of a master composition wherein as diluents metals are used, especially copper.

7 Claims, 1 Drawing Sheet

COMPOSITIONS COMPRISING HEXAFLUOROPHOSPHATES AND METALS AS STRUCTURE REFINER FOR ALUMINIUM-SILICON ALLOYS

The invention relates to hexafluorophosphates for use as structure refiner during the solidification of molten aluminium-silicon alloys, to master compositions capable of effecting this structure refinement comprising hexafluorophosphates and to a process for the structure refining of aluminium-silicon alloys using hexafluorophosphates.

Aluminium-silicon alloys, especially hypereutectic aluminium-silicon alloys (i.e. alloys containing more than about 11% silicon), are widely used for the production of cast products, especially internal combustion engine parts as pistons and valve sleeves. To obtain cast products of a suitable (high) quality it is essential to add a structure refiner to the molten alloy to induce the formation of small crystals during the solidification. This applies to primary silicon crystals in the hypereutectic alloys as well as to silicon crystals formed during solidification of the aluminium-silicon (hypo)eutectic alloys.

In this specification the term structure refiner is used for a compound or composition which, after addition and mixing and/or dissolution in a molten metal or alloy, either as such or as a newly formed compound, induces during solidification the formation of smaller crystals than would have been the case when the structure refiner would not have been added.

Heretofore, phosphorus has been the conventional agent for achieving this purpose. It is presumed that upon dissolving phosphorus or a phosphorus containing compound or composition in a molten aluminium-silicon alloy small particles of aluminium phosphide (AlP) are formed which serve as nuclei for crystallization. The phosphorus may be added in its elemental form or as a compound, for instance phosphorustrichloride or phosphoruspentachloride. These chemicals, either as such or in combination with one or more additives, have in common that they are dangerous when applied for this purpose and that the amount of phosphorus taken up in the aluminium generally varies between 30 and 50%. Therefore, the phosphorus is usually added in the form of a 7 to 15 percent phosphorus-copper alloy, which alloy does not have the before-mentioned disadvantages.

A clear disadvantage of the use of phosphorus-copper alloys for structure refining purposes is the relatively slow dissolution velocity into the molten aluminium-silicon alloy. Usually it takes up to several hours before the phosphorus-copper alloy has been dissolved in such a way that a good structure refinement in the cast product is obtained. If the time between addition and solidification is too short, for instance less than one hour, the phosphorus-copper alloy has not been dissolved completely, and consequently the casting will not yet have the desired fine structure.

SUMMARY OF THE INVENTION

It has now been found that addition of a hexafluorophosphate salt to molten aluminium-silicon alloys is a very effective means for quickly obtaining a good structure refinement during the solidification of the aluminium-silicon alloys. Already after a few minutes a sufficient amount of nuclei is present to obtain after solidification a cast product having the desired fine structure of the silicon phase. Further, the amount of phosphorus taken up in the alloy is very high, usually more than 80%.

The present invention, therefore, relates to hexafluorophosphates for use as structure refiner during the solidification of molten aluminium-silicon alloys. Especially an alkali metal hexafluorophosphate, more especially potassium hexafluorophosphate, may be used.

DETAILED DESCRIPTION OF THE INVENTION

Figure 1:
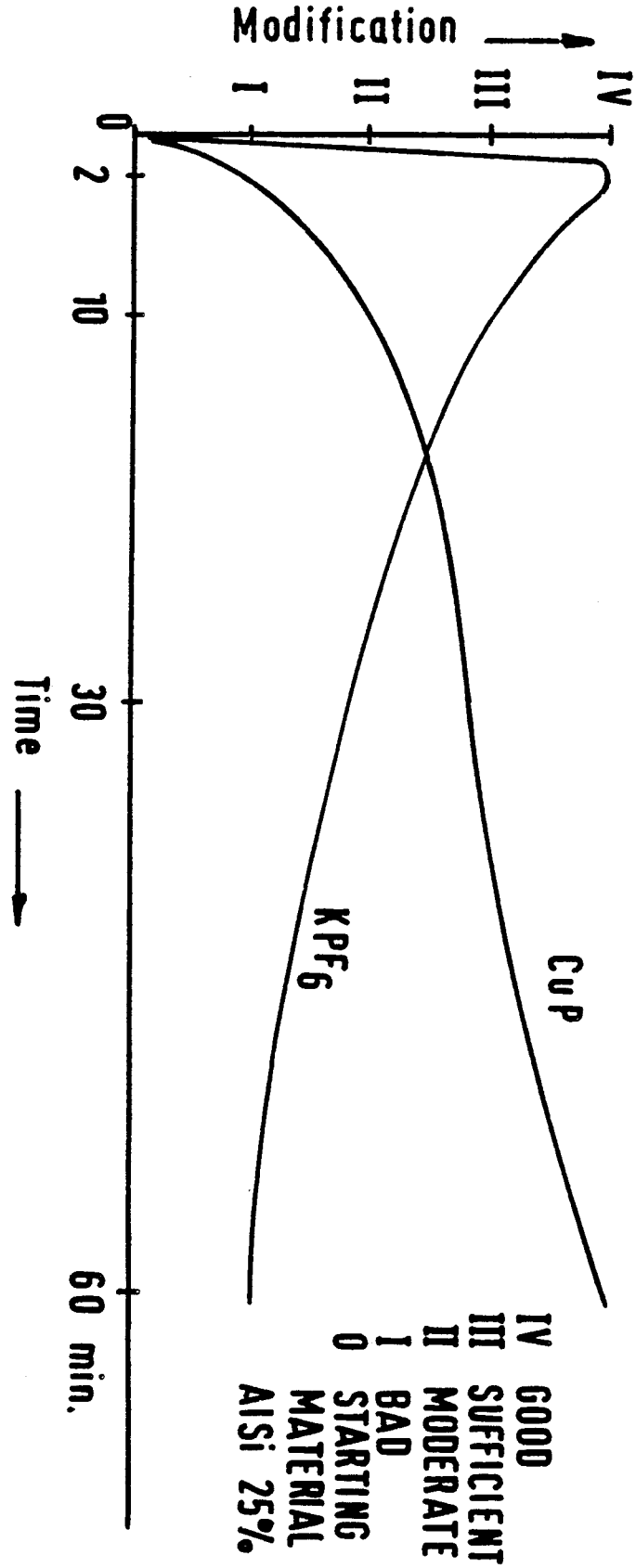
FIG. 1 depicts graphically the results of Example 3 in terms of degree of modification versus time.

The use of the before-mentioned hexafluorophosphates is especially suitable in the case of hypereutectic aluminium-silicon alloys. The amount of silicon in such alloys varies between 11 and 30%, especially between 16 and 26%. Further, some minor amounts of one or more other elements may be present in the alloy, for instance iron (up to 3%), copper (up to 6%), manganese (up to 1%). magnesium (up to 2%), nickel (up to 3%), chromium (up to 1%) zinc (up to 3%) and tin (up to 1%). Also trace amounts of the usual impurities may be present.

The hexafluorophosphates to be used as structure refiner for aluminium-silicon alloys may be used as such, for instance as powder or as compacts, e.g. pressed tablets, optionally coated with or enclosed in a metal foil, for instance aluminium, but are preferably used in the form of a master composition.

Usually the hexafluorophosphate or the master composition is added in a compacted or pressed form to the molten aluminium-silicon alloy in an amount which is at least sufficient to obtain the desired degree of structure refining. In the case of hypereutectic alloys the amount is usually at least sufficient to refine the primary silicon phase of the alloy. The actual amount is determined in each case by the make-up of the particular aluminium-silicon alloy to be treated and the degree of structure refinement desired. Generally, the hexafluorophosphate is added to the molten aluminium-silicon alloy in an amount which introduces at least 0.002% (w/w) phosphorus in the alloy, and preferably between 0.01 and 0.05% (w/w), more preferably between 0.01 and 0.025% (w/w).

Master compositions suitable for addition to molten aluminium-silicon casting alloys to promote the formation of a uniform small silicon crystal size during the solidification of the alloys and comprising a hexafluorophosphate preferably comprise an alkali metal hexafluorophosphate, especially potassium hexafluorophosphate. The amount of hexafluorophosphate may vary between 20 and 80% (w/w), and varies preferably between 30 and 50% (w/w).

Suitable diluents in the master composition are metals. For instance copper, iron, manganese, magnesium, zinc, tin, titanium, nickel or mixtures thereof may be used. Preferred diluents are copper or mixtures of iron, copper, manganese and/or zinc. The use of one or more metals in the master composition makes it possible to introduce at least part of metals which usually are present in commercial aluminium-silicon alloys besides silicon and aluminium. Also phosphorus-containing compounds, for instance a copper-phosphorus alloy, may be included in the master composition. As different phosphorus-containing compounds usually reach their maximum structure refining activity at different periods after the addition to the alloy, addition of one or more suitable phosphorus-containing compounds to the master composition makes it possible to obtain a master composition which has good structure refining properties immediately after addition of the master composition as well as after several hours after addition, thus giving the casting industry a maximal flexibility.

In a preferred embodiment the specific mass of the master composition is higher than the specific mass of the aluminium-silicon alloy. In that case the master composition will immediately after addition disappear below the surface of aluminium-silicon alloy. Thus, contact between the hexafluorophosphate and any oxygen present above the surface of the alloy is avoided, and oxidation of phosphorus, and thus loss of phosphorus, is impossible. Therefore, the specific mass of the master composition is preferably at least 4.3 g/cm$^3$.

In formulating the master composition the hexafluorophosphate may be used in crushed or powdered form. The additives, e.g. metals or phosphorus containing compounds, may also be used in crushed or powdered form. The constituents are mixed in the desired weight ratios and usually compressed or compacted at suitable pressures, with or without the use of a binder, preferably in the form of briquettes or tablets or other convenient shapes of appropriate size. Suitable pressures vary between 100 and 800 N/mm$^2$. If necessary the master composition may also contain silicon fines so as to compensate for the dilution of the silicon content of the casting alloy.

The invention further relates to a process for the structure refining during the solidification of molten aluminium-silicon alloys, comprising addition before casting of a hexafluorophosphate to the molten alloy, preferably an alkali metal hexafluorophosphate, more preferably potassium hexafluorophosphate. The hexafluorophosphates are preferably added in the form of master compositions as described hereinbefore.

EXAMPLES

All tests were carried out in an induction furnace at a temperature of 825° C. An aluminium-silicon alloy containing 25% of silicon was used.

1. Potassium Hexafluorophosphates as Structure Refiner

Potassium hexafluorophosphate was added to different batches of the aluminium-silicon alloy in different ways: as powder enclosed in aluminium foil and as pressed tablets (using different pressures). The amount of hexafluorophosphate used was so calculated that a theoretical amount of 0.05% phosphorus was introduced into the alloy. In all experiments a considerable amount of fume together with fire phenomena were observed. Casting of the obtained refined alloy after 2.5 minutes after addition resulted in products with a clearly refined structure. In products made by casting after 20 minutes or more after the addition of the hexafluorophosphate the structure refining was less clear. Phosphorus recovery in the alloy obtained: 40–70%.

2. Master Compositions Comprising a Hexafluorophosphate as Structure Refiner Master compositions containing potassium hexafluorophosphate were prepared by mixing potassium hexafluorophosphate with copper, a mixture of metals and copper-phosphorus alloy. Thereafter the mixtures were compressed to tablets. The following compositions were made:

| | | |
|---|---|---|
| 1. | 70% $KPF_6$ | 30% Cu |
| 2. | 60% $KPF_6$ | 40% Cu |
| 3. | 50% $KPF_6$ | 50% Cu |
| 4. | 40% $KPF_6$ | 60% Cu |
| 5. | 30% $KPF_6$ | 30% Fe, 25% Cu, 10% Mn, 5% Zn |
| 6. | 30% $KPF_6$ | 70% CuP |

The amount of master composition used was so calculated that a theoretical amount of 0.015% P was introduced into the alloy. Addition of the master compositions to the aluminium-silicon alloy followed by casting resulted in products with a clearly refined structure when casting was performed within 2–40 minutes after addition. Thereafter the structure refining results slowly decreased. The best results were obtained when master compositions 4 and 5 were used. As the specific mass of these compositions (4.43 g/cm$^3$ respectively 4.3 g/cm$^3$) was higher than the specific mass of the aluminium-silicon alloy, the tablets immediately disappeared below the liquid metal surface, thus making oxidation of the phosphorus impossible. In the case of the other master compositions the formation of some fume together with some fire phenomena were observed. Phosphorus recovery in the alloy obtained: 80–100%.

3. Comparison Master Composition Comprising Hexafluorophosphate and a Copper/Phosphorus Alloy A comparison was made between master composition 5 (see Example 2) and a copper/phosphorus alloy (6.8% P). The amount of structure refiner was so calculated that in the alloy a theoretical amount of 0.015% P would be introduced. The results (degree of modification/time between addition and casting) are shown in FIG. 1. From this Figure it appears that the master composition has already good structure refining properties after 2 to 10 minutes, while the copper/phosphorus alloy needs almost one hour to reach the same structure refining properties.

I claim:

1. Master composition suitable for addition to molten aluminum-silicon casting alloys to promote the formation of a refined grain structure during the solidification of the alloys, said composition comprising a hexafluorophosphate in an amount ranging from 20 to 80% (w/w) and one or more metals selected from the group consisting of iron, copper, manganese and zinc.

2. Master composition according to claim 1 in which the hexafluorophosphate is an alkali metal hexafluorophosphate.

3. Master composition according to any one of claims 1–2 in which the amount of hexafluorophosphate ranges from 30 to 50% (w/w).

4. Master composition according to claim 1 having a specific mass of at least 4.3 g/cm$^3$.

5. Master composition according to claim 2 in which the alkali metal hexafluorophosphate is potassium hexafluorophosphate.

6. Master composition according to claim 1 in which said one or more metals comprise copper.

7. Master composition according to claim 3 in which the alkali metal hexafluorophosphate is potassium hexafluorophosphate, said one or more metals comprise copper and which has a specific mass of at least 4.3 g/cm$^3$.

* * * * *